US010426992B2

(12) United States Patent
Sardinas

(10) Patent No.: US 10,426,992 B2
(45) Date of Patent: Oct. 1, 2019

(54) BARBELL MASSAGE APPARATUS

(71) Applicant: Julian Genaro Sardinas, Davie, FL (US)

(72) Inventor: Julian Genaro Sardinas, Davie, FL (US)

( * ) Notice: Subject to any disclaimer, the term of this patent is extended or adjusted under 35 U.S.C. 154(b) by 452 days.

(21) Appl. No.: 15/297,489

(22) Filed: Oct. 19, 2016

(65) Prior Publication Data

US 2017/0105895 A1 Apr. 20, 2017

Related U.S. Application Data

(60) Provisional application No. 62/243,368, filed on Oct. 19, 2015.

(51) Int. Cl.
*A63B 21/072* (2006.01)
*A61H 7/00* (2006.01)
*A61H 23/02* (2006.01)

(52) U.S. Cl.
CPC ..... *A63B 21/0724* (2013.01); *A61H 7/007* (2013.01); *A61H 23/02* (2013.01); *A61H 2201/0153* (2013.01); *A61H 2201/1284* (2013.01); *A61H 2201/1685* (2013.01); *A61H 2201/1695* (2013.01); *A63B 21/072* (2013.01); *A63B 21/0726* (2013.01); *A63B 2209/08* (2013.01)

(58) Field of Classification Search
CPC ..... A63B 21/072; A63B 21/0724; A63B 21/0726; A61H 15/00; A61H 15/0078; A61H 15/0085; A61H 15/0092; A61H 2015/007; A61H 2015/0014; A61H 2015/0021; A61H 2015/0028; A61H 2015/0035; A61H 2015/0042; A61H 2015/005; A61H 2015/0057; A61H 2015/0064; A61H 2015/0071; A61H 7/00; A61H 7/001; A61H 7/002; A61H 23/02
See application file for complete search history.

(56) References Cited

U.S. PATENT DOCUMENTS

| | | | | |
|---|---|---|---|---|
| 7,481,783 | B1 * | 1/2009 | Kelley | A61H 15/0092 601/128 |
| 8,506,461 | B2 * | 8/2013 | Huang | A63B 21/0004 482/108 |
| 9,320,675 | B2 * | 4/2016 | Johnson | A61H 15/0092 |
| 9,408,774 | B2 * | 8/2016 | Rafaeli | A61H 23/0263 |
| 2003/0142512 | A1 * | 7/2003 | Klearman | A44C 15/0015 362/104 |
| 2008/0287272 | A1 * | 11/2008 | Luckadue | A63B 21/027 482/107 |
| 2016/0361223 | A1 * | 12/2016 | Muller | A61H 7/002 |
| 2017/0042759 | A1 * | 2/2017 | Kunnecke | A61H 21/00 |

* cited by examiner

*Primary Examiner* — LaToya M Louis
(74) *Attorney, Agent, or Firm* — The Concept Law Group, PA; Scott D. Smiley; Scott M. Garrett

(57) ABSTRACT

In combination with a barbell having a cylindrical surface, wherein an improvement includes a barbell massage apparatus with a spherical member defining an exterior massage-contact surface and at least two arms extending away from the exterior massage-contact surface that respectively flank two sides of the cylindrical surface of the barbell and retain the barbell massage apparatus thereon, wherein the at least two arms at least partially define a U-shaped channel with the cylindrical surface of the barbell disposed therein.

11 Claims, 19 Drawing Sheets

1000

1500

1600

BARBELL MASSAGE APPARATUS

CROSS-REFERENCE TO RELATED APPLICATION

This application claims priority to U.S. Provisional Patent Application No. 62/243,368 filed Oct. 19, 2015, the entirety of which is incorporated by reference.

FIELD OF THE INVENTION

The present invention relates generally to massaging apparatuses, and, more particularly, relates to a barbell massage apparatus.

BACKGROUND OF THE INVENTION

Massaging has been used over the centuries to relieve various muscle, tendon, and other connective tissue problems. The massaging, kneading, and pressing of muscles fibers modifies and manipulates the muscle tissue that benefits the muscles, the nerves, health of the muscle tissue due to improved blood circulation, removal of waste material from the muscle and connective tissues, and improvement in human body motion and movement. Accordingly, numerous devices are known in the art for massaging the human body.

The fibrous tissue that encloses and separates muscle layers is identified as myofascial tissue. A myofascial trigger point is defined as an irritated area of that tissue, characterized as a taut band of muscle layers that can be very tender and often radiates pain to other areas of the body. Trigger points can be latent, causing stiffness, posture distortion, and motion and movement restriction. Individuals with myofascial pain and related trigger points experience pain in muscle areas, muscle knots and decreased range of motion as well as movement restrictions. Furthermore, these trigger points can result in restricted blood flow through and around the muscle in that vicinity of the trigger point. That blood flow restriction produces significant pain, restricted motion and disability in a person. Currently, there are several ways to treat and relieve trigger points. These ways include physical therapy, massage therapy, acupuncture, active release techniques, and pharmacological treatment. However, these therapies can be expensive. Massage treatment appears to provide a suitable avenue for dealing with these trigger point issues. Trigger points can be released with steady pressure to the trigger point with sufficient force and duration to loosen knotted muscle fibers and improve blood flow into the affected area. Ideally, enough pressure is applied until the patient or oneself cannot tolerate any additional pressure. Unfortunately, particularly for deep tissue massages, the amount of force sometimes required to apply a sufficient amount of pressure to muscle tissue is more than some people are able to provide on their own.

In addition, massage treatment may also be too expensive for some patients to rely upon for a sufficient length of time to address adequately the myofascial pain suffered by the patient or oneself. Accordingly, massaging devices can assist individuals to perform massages to address and/or release these trigger points as well as improve mobility within the body.

Therefore, a need exists to overcome the problems with the prior art as discussed above.

SUMMARY OF THE INVENTION

The invention provides a barbell massage apparatus that overcomes the hereinafore-mentioned disadvantages of the heretofore-known devices and methods of this general type.

With the foregoing and other objects in view, there is provided, in accordance with the invention, a combination with a barbell having a cylindrical surface, wherein an improvement with a barbell massage apparatus including a spherical member defining an exterior massage-contact surface; and at least two arms extending away from the exterior massage-contact surface that respectively flank two sides of the cylindrical surface of the barbell and retain the barbell massage apparatus thereon, the at least two arms at least partially defining a U-shaped channel with the cylindrical surface of the barbell disposed therein.

In accordance with another feature of the present invention, the two arms include a concave inner surface that defines the U-shaped channel, the concave inner surface frictionally retaining the cylindrical surface of the barbell without any external support forces.

In accordance with yet another feature of the present invention, the two arms are of a material that is sufficiently rigid to frictionally retain the cylindrical surface of the barbell within the U-shaped channel without any external support forces.

In accordance with another feature, an embodiment of the present invention includes at least one magnet disposed on at least one of the spherical member and the at least two arms, the magnet operably configured to produce a magnetic field sufficient to retain, without any external non-magnetic support forces, at least a combined weight of the spherical member and the two arms to a metallic structure.

In accordance with yet another feature, each of the arms includes a coupling end and a free end, the coupling end being coupled to the spherical member and the free end being disposed away from the exterior massage-contact surface.

In accordance with an additional feature, the arms include an inner surface that at least partially defines the U-shaped channel, the inner surface being shaped to conform to a shape of a portion of the barbell.

In accordance with another feature of the present invention, the spherical member defines a hollow core.

In accordance with yet another feature of the present invention, the spherical member includes a core that is of a first material different than a second material of an outer layer of the spherical member, the outer layer surrounding the core and including the exterior massage-contact surface.

In accordance with a further feature of the present invention, the first material of the core is denser than the second material of the outer layer.

In accordance with another feature of the present invention, the U-shaped channel includes a width that is 1-4 inches and a depth that is 1-3 inches, the width of the U-shaped channel extending from an inner surface of one of the at least two arms to an inner surface of another one of the at least two arms.

In accordance with yet another feature of the present invention, the spherical member includes a diameter that is 1-4 inches.

In accordance with another feature of the present invention, a spherical member sleeve sized and shaped to removably cover at least a portion of the exterior massage-contact surface, the spherical member sleeve defining a second exterior massage-contact surface.

In accordance with a further feature of the present invention, the spherical member defines at least one groove; and the spherical member sleeve includes at least one lip dimensioned to matingly fasten to the at least one groove so as to secure the spherical member sleeve on the spherical member.

In accordance with yet a further feature of the present invention, the second exterior massage-contact surface includes a plurality of massage projections that extends outwardly and away from the spherical member when the spherical member sleeve is secured to the spherical member through the at least one lip and the at least one groove.

In accordance with another feature, an embodiment of the present invention includes a barbell massage apparatus with a spherical member defining an exterior massage-contact surface; and at least two arms extending away from the exterior massage-contact surface and including a bar-contacting surface that at least partially defines a U-shaped channel dimensioned to matingly receive a cylindrical surface of one of a barbell and a bar portion of a dumbbell and/or kettlebell.

Although the invention is illustrated and described herein as embodied in a barbell massage apparatus, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two as or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of a barbell or a dumbbell and/or kettlebell.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
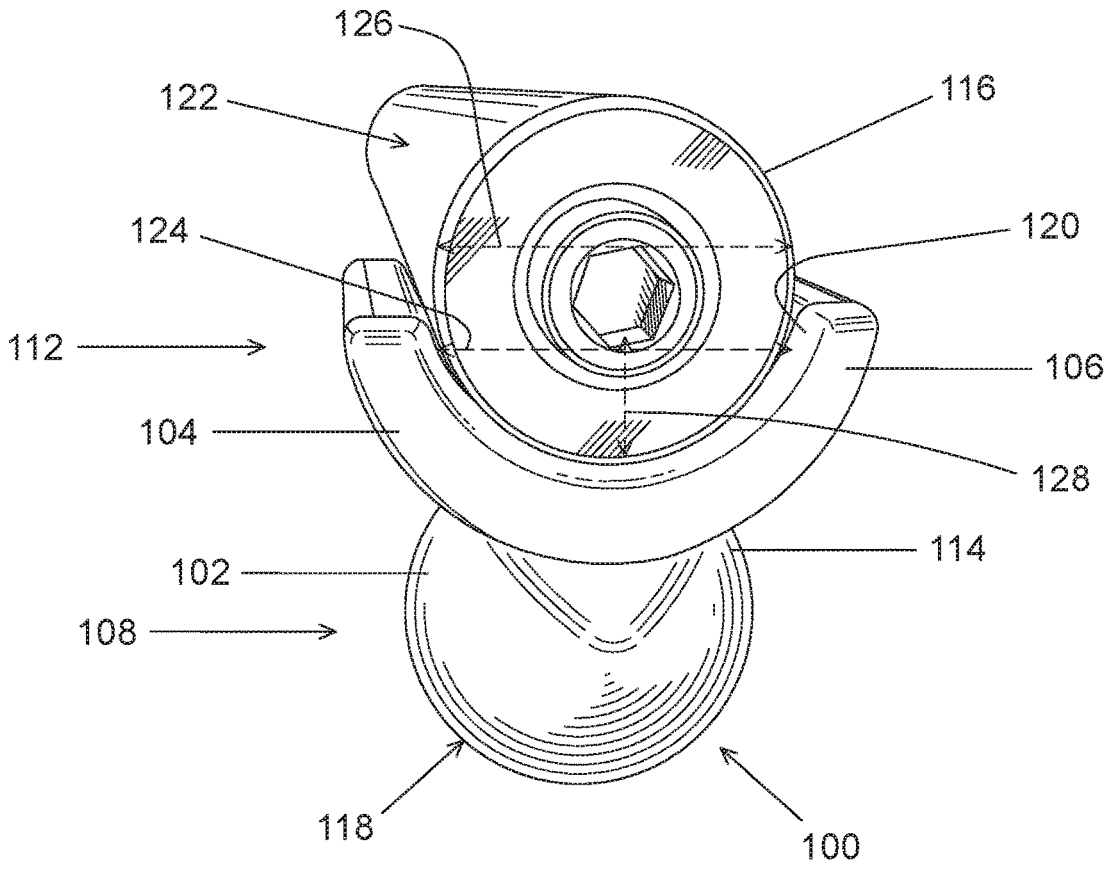
FIG. 1 is a perspective front view of a barbell massage apparatus and a corresponding barbell in accordance with an embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient barbell massage apparatus that, in one embodiment, significantly mirrors the hardness and characteristics of an adult human elbow to provide a deep tissue massage. Such embodiments are effective in relieving muscle and connective tissue conditions and restrictions, including but not limited to trigger points and myofascial release on the foot, calf, leg, hip, glutes, entire arm, back, chest, shoulder, and neck ailments. Embodiments of the invention provide for the barbell massage apparatus to include a spherical massage member and at least two arms extending away from the spherical massage member and at least partially defining a U-shaped channel, wherein the U-Shaped channel permits the barbell to be disposed therein.

In addition, embodiments of the invention provide for the U-shaped channel to be sized and shaped to matingly receive and retain therein a portion of a barbell and/or a bar portion of a dumbbell or kettlebell (collectively referred to as "barbell" in the claims and this specification, unless otherwise specifically stated otherwise). In such embodiments, the barbell or dumbbell may provide a dual-purpose as a handle to maneuver the barbell massage apparatus on a subject's muscle fibers and tissue and also as a heavy weight to conveniently provide weighted pressure on the barbell massage apparatus to apply pressure on the subject's muscle fibers and tissue. Stated another way, the weight of the barbell (e.g., an empty barbell, which can vary in weight and size and is typically between 35 and 55 lbs.) or the dumbbell weight can provide significant pressure or force on the barbell massage apparatus and ultimately on the human subject's muscle fibers and tissue. Applying pressure to muscle tissue during deep tissue massages, particularly on muscular and overweight individuals, can be especially strenuous to the person applying the pressure and over time can lead to injury. Accordingly, embodiments of the present invention advantageously at least partially alleviate the need for the massage professional (or the subject, in the case of a self-massage session) to exert as much force during the massage as would be required without the weighted assistance.

Figure 2:
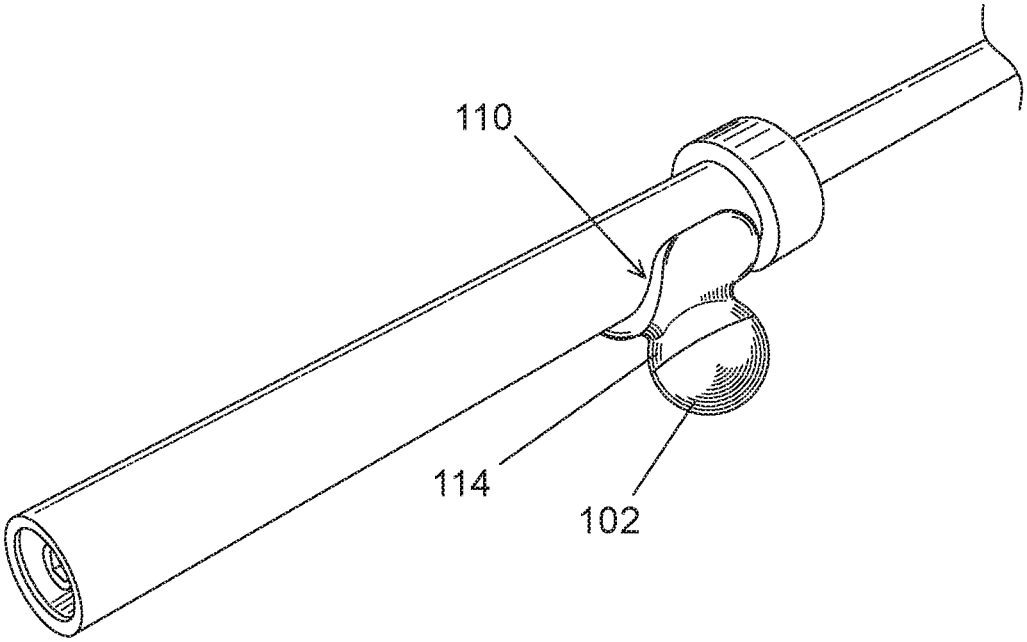
FIG. 2 is a perspective side view of the barbell massage apparatus and the barbell of FIG. 1, in accordance with the present invention.

Referring now to FIGS. 1 and 2, one embodiment of the present invention is shown in a perspective views. FIGS. 1 and 2 shows several advantageous features of the present invention, but, as will be described below, the invention can be provided in several shapes, sizes, combinations of features and components, and varying numbers and functions of the components. The first example of a barbell massage apparatus 100, as shown in FIG. 1, includes a spherical member 102, a first arm 104, and a second arm 106.

In one embodiment, the barbell massage apparatus 100 can be seen as having the spherical member 102 at a first end 108 of the apparatus 100 and a U-shaped channel 110 disposed at a second end 112 of the apparatus 100. The first end 108 may be opposite the second end 112. The spherical member 102 and the U-shaped channel 110 are coupled together at a joint 114 and may beneficially be, in one embodiment, formed as an integrated or uniform piece through, for example, injection molding.

Figure 5:
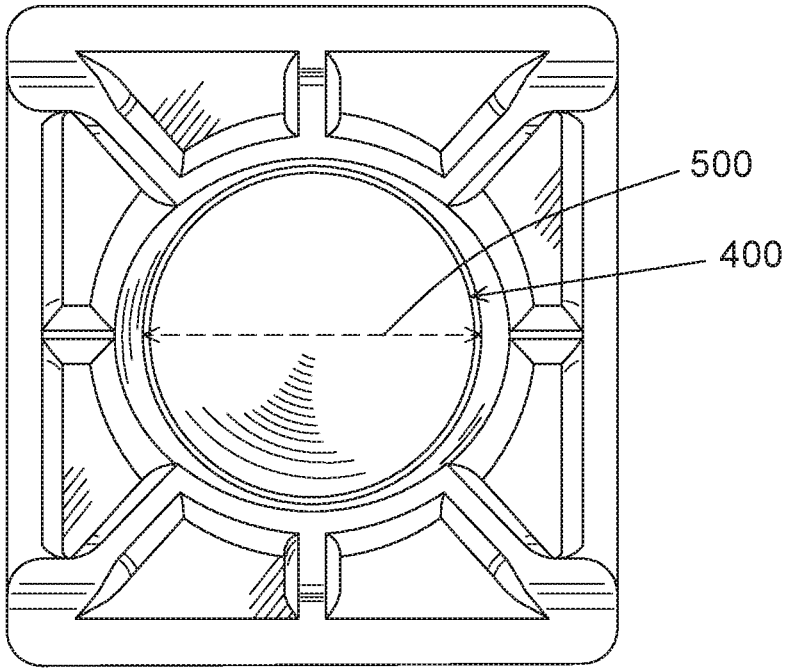
FIG. 5 is a bottom view of the barbell massage apparatus of FIG. 1, in accordance with the present invention.

The U-shaped channel 110 may be at least partially defined by the first arm 104 and the second arm 106. In one embodiment, the first and second arms 104, 106 are integral/continuous with one another as said arms 104, 106 form the U-shaped channel 110. In another embodiment, the first and second arms 104 and 106 are separate but coupled to one another to form the U-shaped channel 110. In yet another embodiment, the first and second arms 104, 106 may be considered to be coupled to and extending away from the spherical member 102. In yet another embodiment, the first and second arms 104, 106 may be considered to be coupled to and extending away from the joint 114. The mid-section or joint 114 can also be referred to as a neck portion of the spherical member 102, with the arms 104, 106 coupled to and extending away from the neck portion 114. In a preferred embodiment, the neck portion 114 includes a diameter 500 (see FIG. 5) that is 2.15 inches and a neck circumference that is 6.8 inches. In yet other embodiments, the neck portion 114 may include a diameter 500 that is more than or less than 2.15 inches and a circumference that is more than or less than 6.8 inches. In one embodiment, the arms 104, 106, spherical member 102, and neck portion 114 may be a continuous one-piece structure as mentioned above. In another embodiment, one or more of the arms 104, 106, spherical member 102, and neck portion 114 may be separate structures, but may still be coupled to one another for form the barbell massage apparatus 100.

Figure 9:
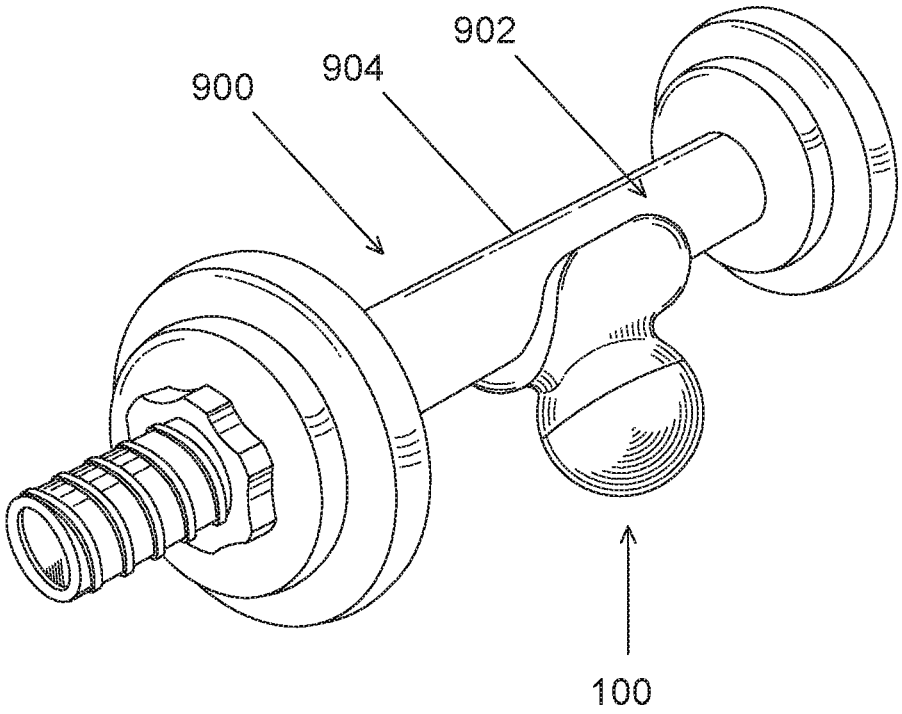
FIG. 9 is perspective side view of another exemplary barbell massage apparatus disposed for use with a dumbbell, in accordance with the present invention.

In one embodiment, the U-shaped channel 110 may be defined by more than two arms 104, 106 that may flank two sides of a cylindrical surface 122 of a barbell 116 as shown in FIGS. 1 and 9. In one embodiment, the two sides of the cylindrical surface 122 of the barbell 116 may be opposing each other. For example, in one embodiment, the U-shaped channel 110 may be defined by a plurality of curved fingers shaped and configured to grip to a barbell 116 or a dumbbell 900 (see FIG. 9). In yet other embodiments, the U-shaped channel 110 may be defined by other structures. The term "U-shaped," as used herein is not limited to a literally U-shaped structure. Instead, the term "U-shaped" is intended to describe any structure that is physically similar to the letter "U", in that it has at least two opposing side surfaces and a bottom surface (which may or may not contact the barbell) interposing said side surfaces, and includes other shapes, such as a "V" or other like shapes. In other embodiments, the channel 110 may be formed as other shapes, such as for example an O-shaped channel.

Importantly, the spherical member 102 defines an exterior massage-contact surface 118. In one embodiment, the exterior massage-contact surface 118 may be of a resilient and substantially rigid material, such as, a rubber, plastic, or other polymer material, that provides a comfortable contact surface layer with the skin or on a person's clothing and/or garment. The spherical member 102 should still be sufficiently rigid to be able to transfer pressure to a subject's muscle tissue for massaging and generally retain its shape. In one embodiment, the exterior massage-contact surface 118 may be a smooth surface. In another embodiment, the exterior massage-contact surface 118 may include protrusions and/or depressions to provide a different massage feel than a smooth surface would, as illustrated in FIG. 8. The exterior massage-contact surface 118 may be made of other materials in other embodiments, such as, for example, wood, metallic, etc. In one exemplary embodiment, the surface 118 may be polyvinyl chloride having a Rockwell Shore A hardness within a range of approximately 60-100. In other embodiments, the material of the surface 118 may vary and the hardness may exceed a Shore A of 100. In preferred embodiments, the two arms 104, 106 are also of the same material and hardness as the outer surface 118.

Figure 3:
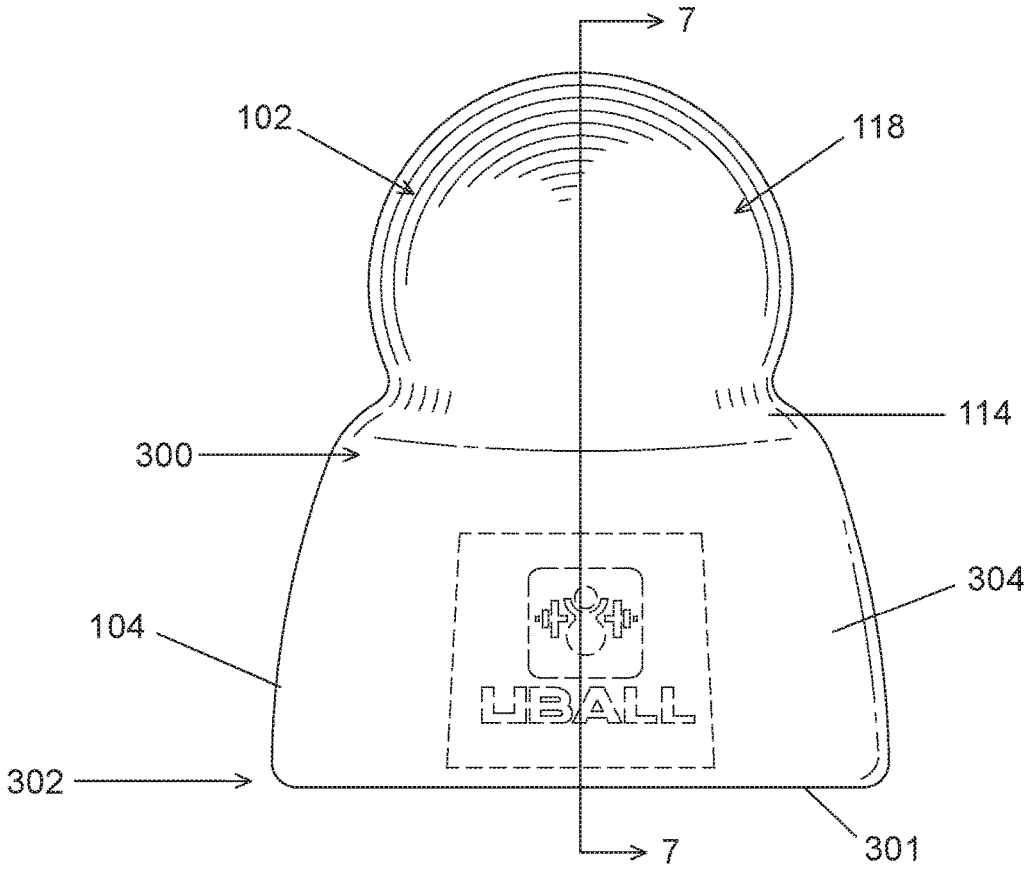
FIG. 3 is a side view of the barbell massage apparatus of FIG. 1, in accordance with the present invention.
Figure 4:
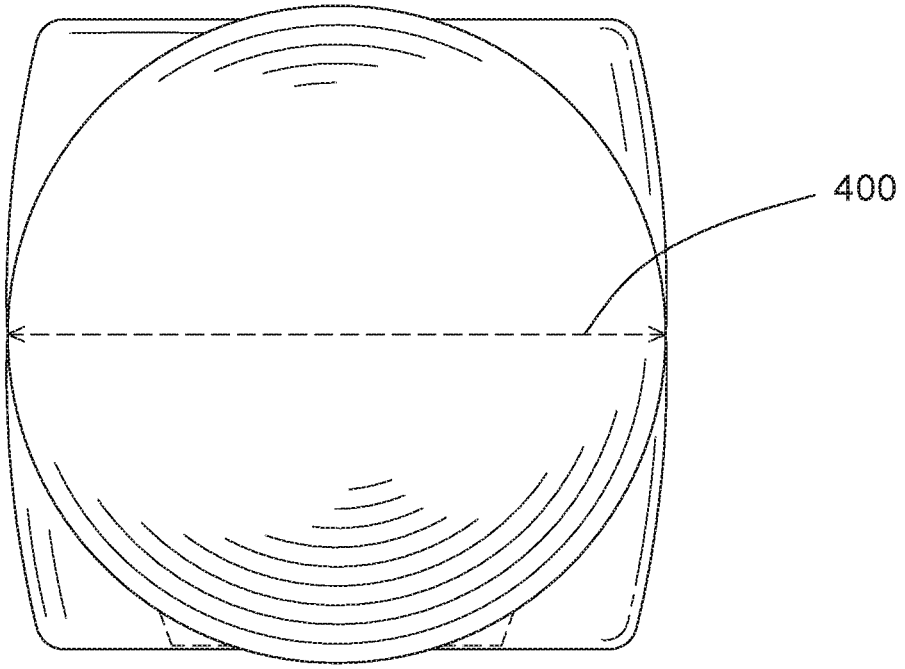
FIG. 4 is a top plan view of the barbell massage apparatus of FIG. 1, in accordance with the present invention.

In a preferred embodiment, the spherical member 102 is sized and shaped to correspond to a size and a shape or a feeling of an average-sized adult human elbow, as can be seen in FIG. 3. Further, the spherical member 102 may be configured to mirror the hardness and characteristics of an average-sized adult human elbow, to provide deep tissue massage for providing and creating elasticity in the muscle and connective tissues. In another embodiment, the spherical member 102 may include a diameter 400 that is 1-4 inches (see FIG. 4). In yet another embodiment, the spherical member 102 may include a maximum diameter 400 that is more than 4 inches. In a preferred embodiment, the spherical member 102 includes a diameter that is 2.25 inches and a circumference that is 7.2 inches.

In one embodiment, the spherical member 102 may be considered a round ball-like structure and the U-shaped channel 110 can be pressed and used to apply pressure on the human body. The apparatus 100 can also be utilized on a floor or a wall or an exercise/fitness rack or rig to apply pressure on the human body. Said another way, the apparatus 100 can be placed with its second end 112 resting on a floor surface and its first end 108 facing away from the floor surface, wherein the user would then rest or otherwise place him or herself on top of the first end's 108 ball-like structure. The barbell massage apparatus 100 can also be used or manipulated by the user, i.e., with or without his or her hands holding the apparatus 100, or can be utilized in conjunction with the barbell 116 and/or the dumbbell 900 (see FIG. 9) as exemplified in FIGS. 1-2 and FIG. 9, respectively.

In one embodiment, there may be provided a pair of rubber footies sized, shaped, and configured to cover a bottom edge 301 (see FIG. 3) of the arms 104, 106 so as to prevent the apparatus 100 from sliding when the arms 104, 106 are in contact with a surface, such as, the floor surface. In another embodiment, there may be provided an adhesive rubber strip that may be selectively adhered to the bottom edge 301 of the arms 104, 106 so as to prevent sliding. In yet another embodiment, the bottom edge 301 of the arms 104, 106 may be made of a friction-reducing material (e.g., rubber) so as to provide the friction-reducing surface at the bottom edge of the arms 104, 106 to prevent sliding. In a further embodiment, the bottom edge 301 of the arms 104, 106 may be made of one type of material, such as the friction-reducing surface material (e.g., rubber), while a remainder of the apparatus 100 may be made of another material.

In one embodiment, the spherical member 102 may be selectively coupled to the neck portion 114 and/or the arms 104, 106. For example, in one embodiment, a bottom portion of the spherical member 102 may be selectively screwed to the neck portion 114 and/or the arms 104, 106. In a further embodiment, the bottom portion of the spherical member 102 may include threading and a top portion of the neck portion 114 and/or the arms 104, 106 may include mating threading for selectively screwing the spherical member 102 to the neck portion 114 and/or the arms 104, 106. In other embodiments, there may be provided other shapes and joint structures for selectively coupling and uncoupling the spherical member 102 from the neck portion 114 and/or the arms 104, 106, such as, for example, clamps, clips, and other types of joints or fasteners. In one embodiment, such selectively coupling of the spherical member 102 may provide for an option to selectively screw/couple other shaped or sized members to the neck portion 114 and/or the arms 104, 106. For example, in one embodiment, there may be provided massage members of varying spherical sizes or other non-spherical shapes, such as, for example, cone-shaped, rectangular-shaped, oblong-shaped and the like, which the user may desire to alternate with the spherical member 102 for various purposes.

The arms 104, 106 may define a bar-contacting surface 120. The bar-contacting surface 120 may at least partially define the U-shaped channel 110. In a further embodiment, the U-shaped channel 110 may be dimensioned to matingly receive and retain therein a cylindrical surface 122 of the barbell 116, as shown in FIGS. 1 and 2. In another embodiment, the U-shaped channel 110 may be dimensioned to matingly receive and retain therein a cylindrical surface 902 of a bar portion 904 of the dumbbell 900, as shown in FIG. 9. As is generally known, a barbell is conventionally a long metallic bar to which disks of varying weights may be attached at its opposing ends for weightlifting purposes and a dumbbell is conventionally a relatively short bar with weights at its ends for weight lifting.

In another embodiment, the bar-contacting surface 120 may be considered a concave inner surface 120 defining the U-shaped channel 110. The concave inner surface 120 may be sized and configured to matingly receive the cylindrical surface 122 the barbell 116. In another embodiment, the concave inner surface 120 may be sized and configured to matingly receive the cylindrical surface 902 of the dumbbell 900. Stated another way, the inner surface 120 may be shaped to conform to a shape of a portion of the barbell 116 or the dumbbell 900 when directly contacting the portion for coupling the apparatus 100 to the barbell 116 or the dumbbell 900. In yet other embodiments, the bar-contacting surface 120 may be sized and shaped to matingly receive other cylindrical surfaces, such as, a kettle ball.

In one embodiment, the inner surface 120 may be sized, shaped, dimensioned, and/or configured to frictionally retain the cylindrical surface 122 of the barbell 116 within the U-shaped channel 110 without any external support surfaces. Stated another way, the apparatus 100 may be mechanically fastened to the barbell 116 (or the dumbbell 900) via the compression forces generated by the arms 104, 106 that form the U-shaped channel 110. As such, a width 124 separating the arms 104, 106 of the U-shaped channel 110 may, in some embodiments, be slightly less than a width 126 of a corresponding barbell 116 (or the bar portion 904 of the dumbbell 900) inserted therein. In other words, the arms 104, 106 may be configured to clasp or lock onto the barbell 116. As referenced above, in the following descriptions and claims (unless specifically noted otherwise), for the sake of brevity and clarity, the term "barbell 116" will be used, but it should be understood that other embodiments may be likewise configured for use with the dumbbell 900, as depicted in FIG. 9.

The arms 104, 106 may be made of a material sufficiently rigid and resilient to potentially expand (laterally) and frictionally retain the cylindrical surface 122 of the barbell 116 within the U-shaped channel 110 without any external support forces. In one embodiment, the arms 104, 106 may be made of a plastic, rubber, or other polymer material. In other embodiments, the arms 104, 106 may be made of rigid to semi-rigid non-polymer materials.

In other embodiments, the apparatus 100 may be coupled to the barbell 116 using magnetic force(s) generated by the material of the apparatus 100, material attached/affixed to the apparatus 100, material included with the apparatus 100, or the apparatus 100 may simply rest on the cylindrical surface 122 of the barbell 116 and may be retained against the user using the weight of the barbell 116. The user may then utilize the weight of the barbell 116 to apply additional pressure on the human body to substantially alleviate pain and discomfort associated with muscle or connective tissue conditions. Advantageously, the apparatus 100 enables progressive deep tissue massage in systematic and progressive steps either by itself and/or with the use of the barbell 116 that enhances the treatment of myofascial trigger points in a human body.

In yet another embodiment, the U-shaped channel 110 may include a ball bearing or other type of rolling, sliding, and/or translating element that is operably configured to roll, slide, and/or otherwise translate the apparatus 100 along the shaft of the barbell 116 as desired by the user. The ball bearing may be positioned, for example, in a center portion of the U-shaped channel 110.

Figure 7:
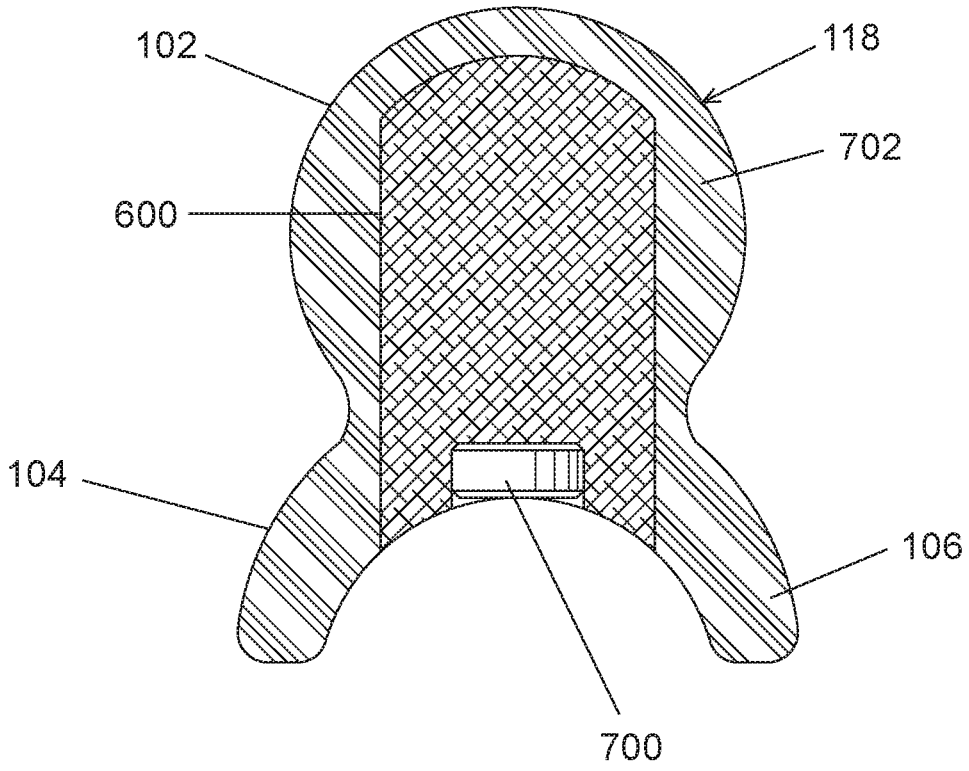
FIG. 7 is a cross-sectional view of the barbell massage apparatus of FIG. 3 along section line 7-7, illustrating an inner core disposed within a spherical outer layer, in accordance with the present invention.

Referring now briefly to FIG. 7 in conjunction with FIG. 1, in an embodiment in which magnetic forces couple the apparatus 100 to the barbell 116, the apparatus 100 may include at least one magnet 700. In one embodiment, the magnet 700 may be disposed on the spherical member 102 and/or the arms 104, 106 and may be operably configured to produce a magnetic field sufficient to retain, without any external non-magnetic support forces, at least a combined weight of the spherical member 102 and the arms 104, 106. In a further embodiment, there may be more than one magnet 700. Said another way, the apparatus 100 may include one or more strategically placed magnets 700 producing a sufficient magnetic field to retain at least the weight of the apparatus 100 on a metallic surface, such as the cylindrical surface 122 of the barbell 116. In another embodiment, the magnets 700 may generate enough magnetic fields to exceed the weight of the apparatus 100 by at least 10%. In yet other embodiments, the magnets 700 may generate magnetic fields sufficient to retain a weight well above the weight of the apparatus 100, but not too much force so as to prevent the user from removing the apparatus 100 from the metallic surface 122, when so desired.

Figure 10:
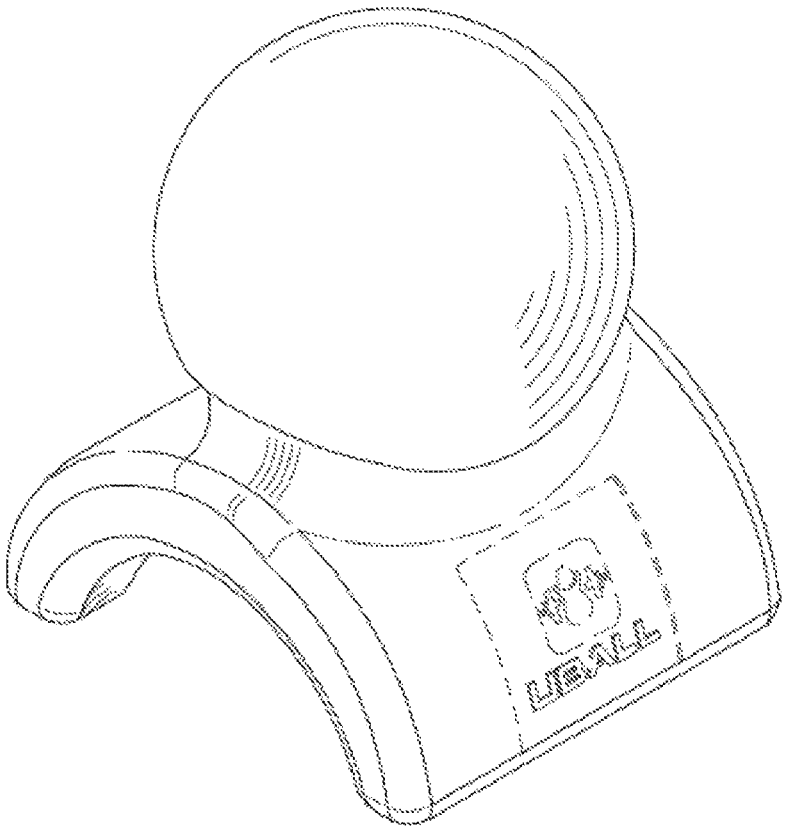
FIGS. 10-16 depict various views of a barbell massage apparatus in accordance with the present invention.
Figure 11:
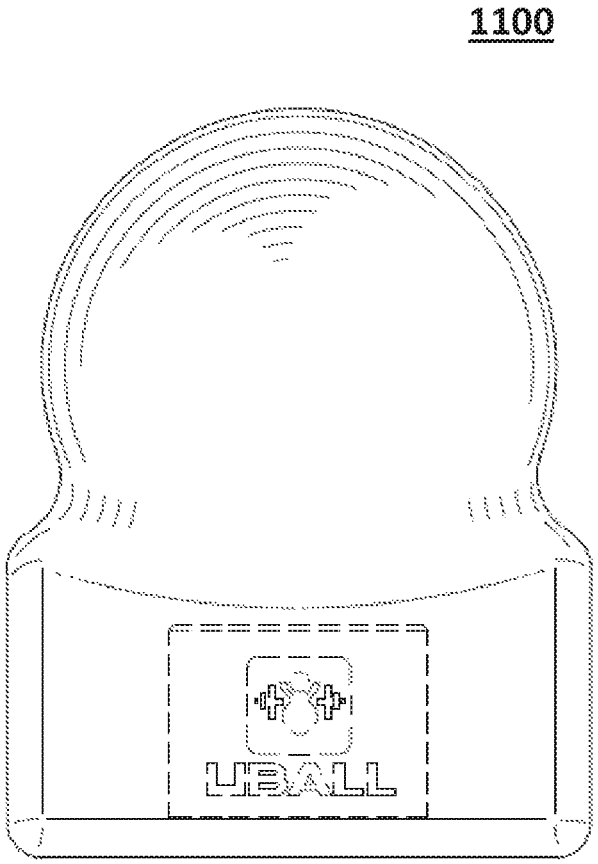
Figure 12:
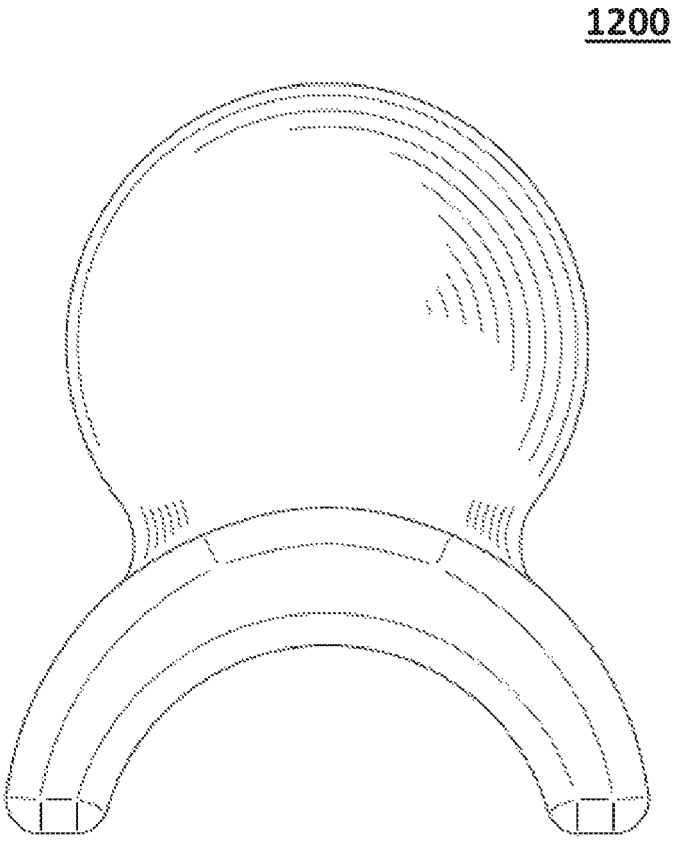
Figure 13:
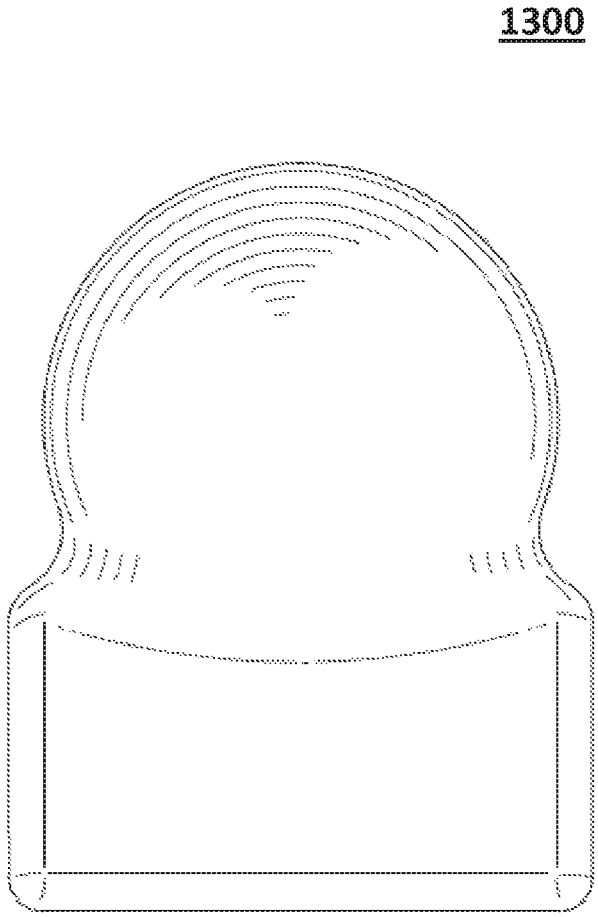
Figure 14:
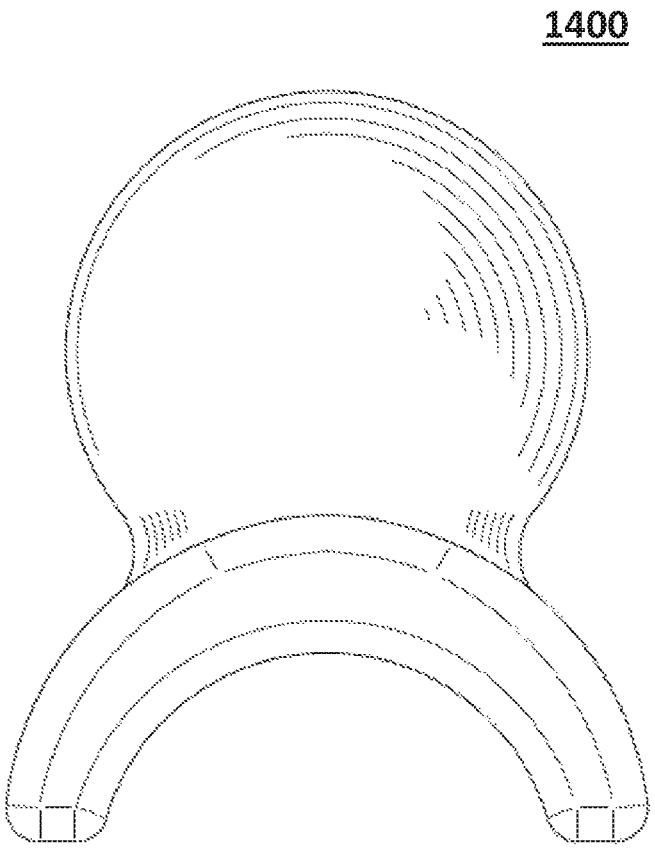
Figure 15:
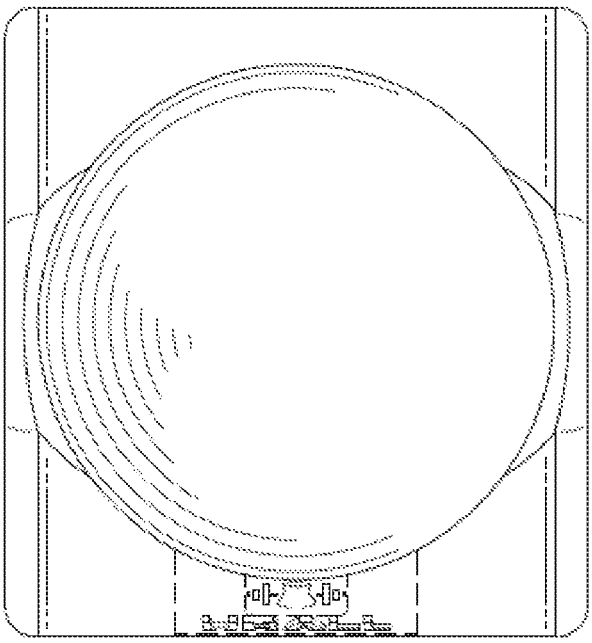
Figure 16:
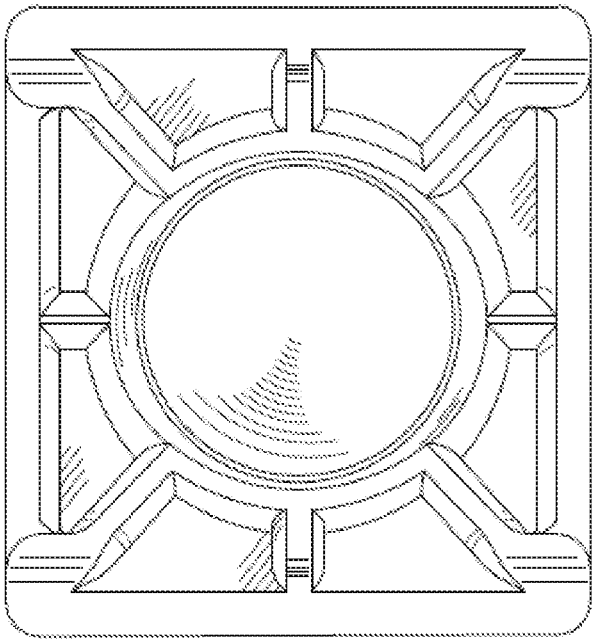

Referring now primarily to FIG. 3 with brief reference also to FIG. 1, each of the arms 104, 106 may be considered a mirror image of the other and may include a coupling end 300 and a free end 302. The coupling end 300 may be coupled to the spherical member 102. In other embodiments, the arms 104, 106 are symmetrical with respect to one another about a plane that spans through the centroid of the apparatus 100 and/or spherical member 102 (as roughly estimated with the arrow 400 in FIG. 4). In further embodiments, the plane may span through the center of mass of the spherical member 102 to promote a more effective and balanced device. Another embodiment is shown in FIGS. 10-16, which show various views of a barbell massage apparatus in accordance with the present invention that is substantially similar to that shown in FIG. 3. FIG. 10 shows a perspective view 1000, FIG. 11 shows an elevational front view 1100, FIG. 12 shows an elevational right side view 1200, FIG. 13 shows an elevational rear view 1300, FIG. 14 shows an elevational left side view 1400, FIG. 15 shows a top plan view 1500, and FIG. 16 shown a bottom plan view 1600 of a barbell massage apparatus.

More specifically, in one embodiment, the coupling end 300 may be considered to be coupled to the neck portion 114 of the spherical member 102. Such coupling may be by fasteners or joints, or may be directly coupled as a continuous structure (e.g., injection molded). In one embodiment, the arms 104, 106 may be removeably couplable in order to be interchangeable relative to the spherical member 102. In other words, the spherical member 102 and the arms 104, 106 that form the U-shaped channel 110 may be interchangeable so as to have other shapes, materials, or thicknesses. For example, some user's may prefer a spherical member 102 that is metallic rather than plastic; other users may prefer an exterior massage-contact surface 118 that is not spherical-shaped; yet other users may prefer a multitude of finger-like grips that generally form the U-shaped channel 110 rather than having a continuous surface forming the U-shaped channel 110 as in the exemplary embodiment, etc. Removeably couplable fasteners that may be used in an embodiment that permits interchangeability should still be sufficiently secure to withstand massaging forces and the weight of the barbell 116 thereon.

The free end 302 may be an end disposed away from the exterior massage-contact surface 118. In one embodiment, the free end 302 may be disposed opposite from the coupling end 300. In one embodiment, a strap or cord may be coupled to the free end 302, or another portion of the U-shaped channel 110 so as to ensure that the U-shaped channel 110 is properly attached and secured to the barbell 116. The strap (not shown) may be selectively tightened and/or loosened by the user to further secure and/or release the barbell 116 within the U-shaped channel 110. In other embodiments, the apparatus 100 may not include the strap.

In one embodiment, the free end 302 may include a flat, planar bottom edge 301, as can be can be seen in FIG. 3. In another embodiment, the free end 302 may be provided with a knuckle-shaped bottom edge 301. In other words, the bottom edge 301 may be shaped as rounded or wave-like, with undulating surfaces, rather than flat, planar surfaces.

In one embodiment, the arms 104, 106 may include an exterior surface 304 that is smooth, as can be seen in FIG. 3. In another embodiment, the exterior surface 304 can be formed as a textured surface. Such textured surfaces may provide for a griping surface that is improved over a smooth gripping surface in terms of preventing slippage. Such textured surface may be provided with a plurality of protrusions of various shapes and configurations interposed between a plurality of smooth surfaces. In other words, the textured surface may include a plurality of ridge surfaces between a plurality of recessed surface portions, similar in some embodiments, to the tread patterns of a tire, for example. In one embodiment, the textured surface may be formed as a plurality of square-shaped protrusions arranged as neighboring squares. In other embodiments, the textured surface of the exterior surface 304 of the arms 104, 106 may be provided in other arrangements and with other shapes. The arms 104, 106 may also include edges and corners that may be used by the user to scrape along or rub along the user's body to promote soft tissue health as an Instrument Assisted Soft Tissue Mobilization (IASTM) treatment device. IASTM assists with resolving pain and tightness in the body. This approach reduces friction, which allows preciseness, sensitivity and depth that cannot be accomplished with the hands, knuckles, and elbows, etc. according to some experts. IASTM devices generally make is easier to detect and treat fascial dysfunction.

Referring again primarily to FIGS. 1-2, in one embodiment the arms 104, 106 may be continuous with one another all the way around. In other words, in one embodiment, the arms 104, 106 may form a circle of a diameter sufficient to receive the barbell 116 therethrough for coupling the barbell 116 to the apparatus 100. In such an embodiment, the arms 104, 106 may be considered to not include a free end 302. Stated yet another way, the second end 112 may be formed in the shape of an enclosed circle such that the user would slide the apparatus 100 over an end of the barbell 116.

In one embodiment, the width 124 of the U-shaped channel 110 may be 1-4 inches. More specifically, a maximum width 124 of the U-shaped channel 110 may be 1-4 inches, with the width 124 being a distance that extends from a portion of the inner surface 120 of one of the arms 104 to a portion of the inner surface 120 of the other arm 106, with the portions being opposing surfaces. In other words, the width 124 may be a distance separating the opposing arms 104, 106 and may, in some embodiments, be the width separating the free ends of the arms 104, 106. In one embodiment, the U-shaped channel 110 has a depth 128 that is 1-3 inches. In another embodiment, the U-shaped channel 110 has a depth 128 that is more than or less than 1-3 inches. In yet another embodiment, the overall dimensions of the apparatus 100 are 3.5 inches in height, 2.75 inches in width, and 3 inches in length (represented in FIG. 5 as arrow 502). In yet other embodiments, the above-described dimensions may vary in accordance with design constraints and particular applications. For example, the inner surface 120 may extend the entire length 502 of the members 104, 106 and may be approximately the same length as the diameter 400 of the spherical member 102.

Figure 6:
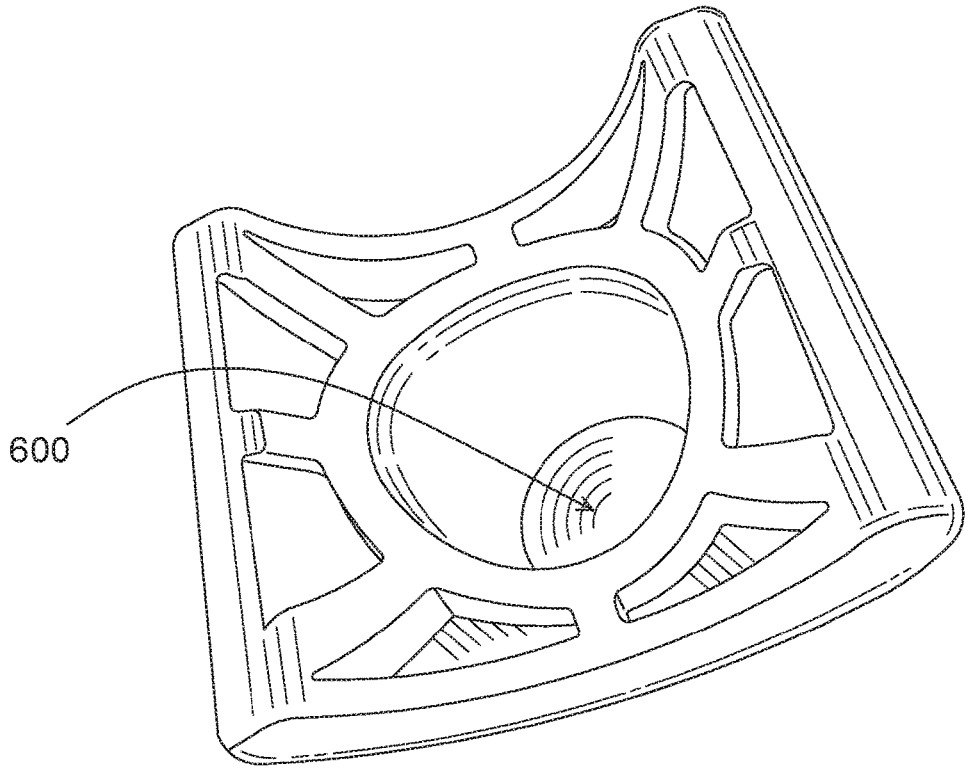
FIG. 6 is a perspective bottom view of the barbell massage apparatus of FIG. 1, in accordance with the present invention.

Referring now to FIGS. 6-7, with brief reference to FIG. 1, the spherical member 102 is shown with a hollow core 600. More specifically, in one embodiment, the spherical member 102 may include an outer layer 702 that defines the hollow core 600. The outer layer 702 may be of a material (e.g., plastic or polymer) that is of a hardness and rigidity sufficient to retain its shape when a massaging pressure and/or the weight of the barbell 116 is applied to it, even with the hollow core 600. In other words, in such an embodiment, the material of the outer layer 702 may be of a sufficient strength/hardness such that a reinforcing filler material may not be required. It is understood that although the term "hollow core" is used, the core 600 may be considered hollow even though it may be filled with air.

In another embodiment, the core 600 may include one or more electronic and/or mechanical devices, which may include but is not limited to a motor, that is operably configured to vibrate or otherwise cause the spherical member 102 to continuously and rapidly move. There may be provided, on an external surface of the apparatus 100, a button or other actuator operably configured to permit the user to selectively vibrate the spherical member 102 for massaging purposes. In yet other embodiments, the core 600 may not include any electrical devices therein.

In an alternative embodiment, the core 600 may be made of a material (not air) that enhances the effects of the deep massaging effect of the barbell massage apparatus 100. In one embodiment, the core 600 defined by the spherical member 102 may be made of a first material that is different than a second material from which the outer layer 702 is made. Stated another way, the outer layer 702 may be considered to surround the core 600, which may be made of a different material than the outer layer 702. The outer layer 702 may be considered to include the exterior massage-contact surface 118. As an example, in one embodiment, the core 600 may be of a denser material than the material of the outer layer 702. In a further embodiment, the outer layer 702 may be made of a soft material, such as a soft rubber or polyurethane foam, silicone, stainless steel, or other material to comfortably contact the user's skin while the inner core 600 may be of a denser material, such as, for example, a denser rubber, or a metallic core. Accordingly, the outer layer 702 may be applied softly to the skin over a muscle. By applying additional pressure to the apparatus 100, the user may apply pressure to the muscle from denser material beneath the outer layer 702 that is provided by the denser core 600. Applying additional pressure to the apparatus 100 may allow for firmer pressure to be applied from the hard spine, while at the same time cushioning the muscle with one or more of the more pliant outer layers 702.

Referring now generally to FIGS. 8A-8D, embodiments of the present invention are described in which the barbell massage apparatus 100 includes one or more interchangeable sleeves 800*a-n*. The number of sleeves can be any number between "a" though "n," where "a" is the number one (1) and "n" can be any number greater than one (1), however for succinctness only 800*a-d* are shown in FIGS. 8A-8D, respectively. In one embodiment, the sleeve 800 is shaped to removeably cover at least a portion of the exterior massage-contact surface 118. In another embodiment, the sleeve 800 may be considered to be curved or have an inner concave surface shaped to mate with the spherical member 102. More specifically, the sleeve 800*a-d* may be shaped to matingly cover at least a top portion of the spherical member 102. In a further embodiment, the sleeve 800 may be shaped to matingly cover at least one half of the surface area of the exterior massage-contact surface 118, as can generally be discerned in FIGS. 8A-8D.

Figure 8A:
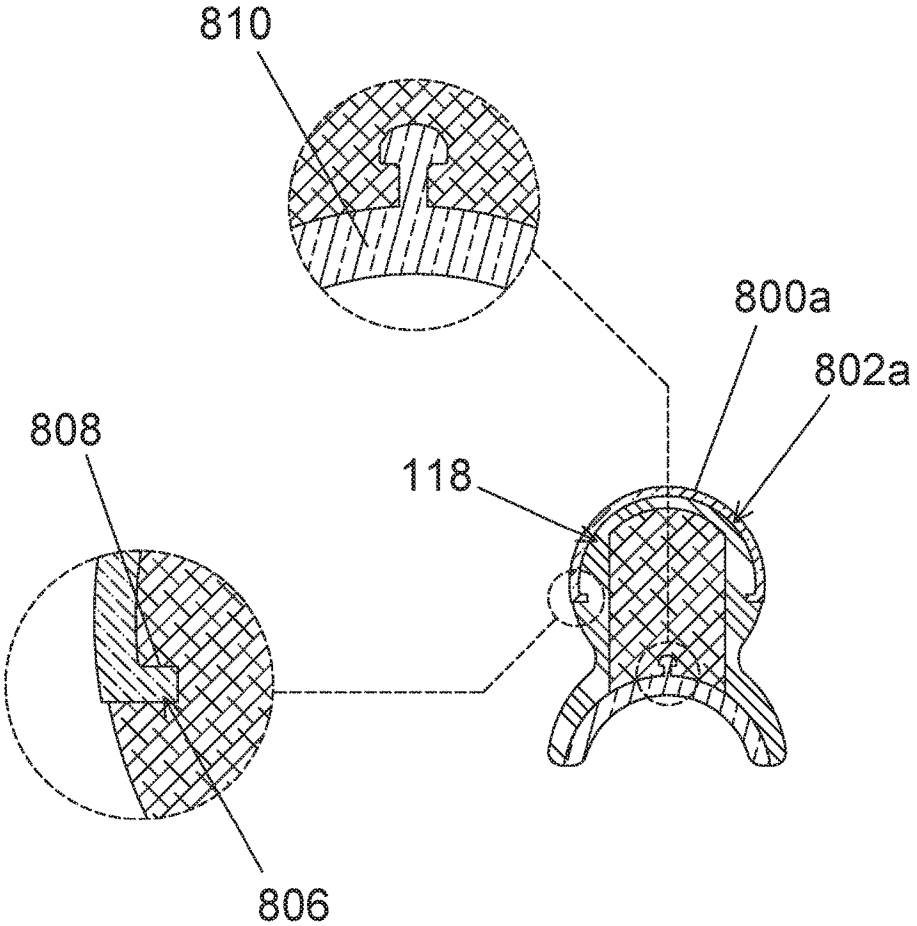
FIGS. 8A-8D are schematic views with cross-sectional illustrations of further exemplary embodiments of the barbell massage apparatus of FIG. 1, showing various removable sleeve covers, in accordance with the present invention.
Figure 8B:
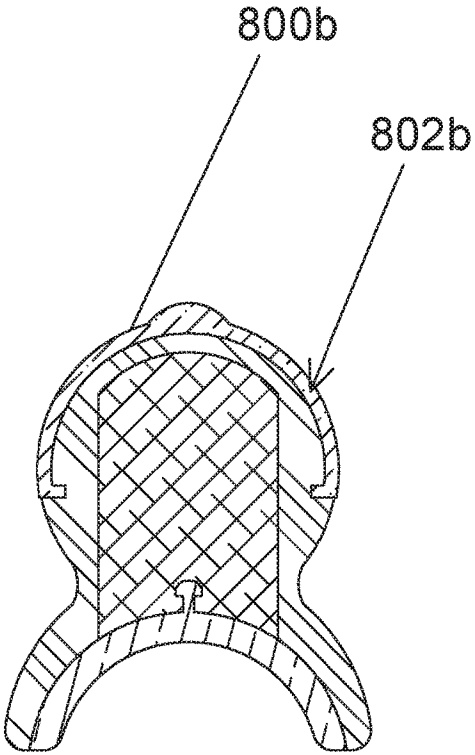
Figure 8C:
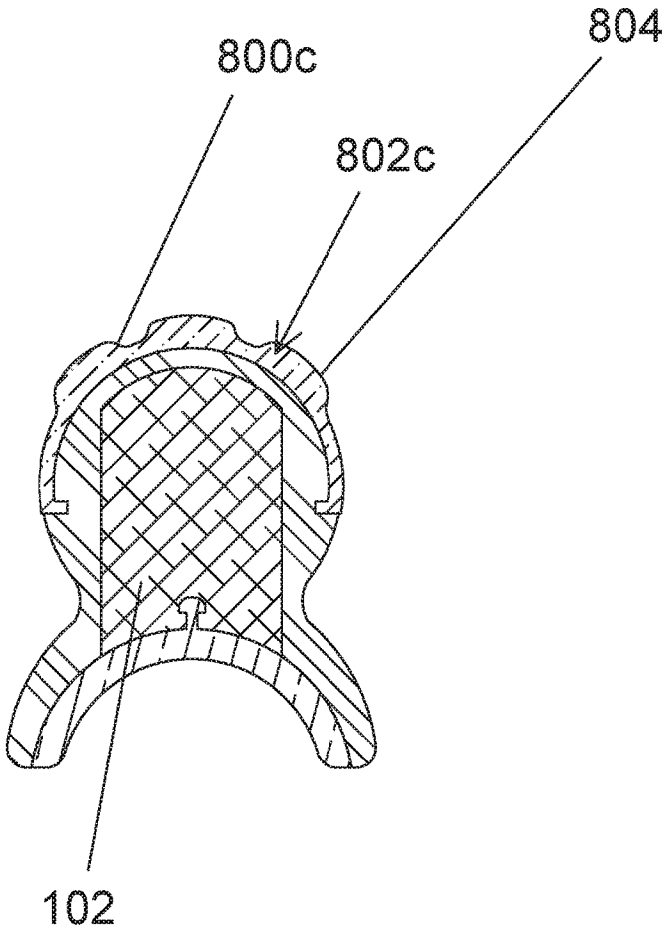
Figure 8D:
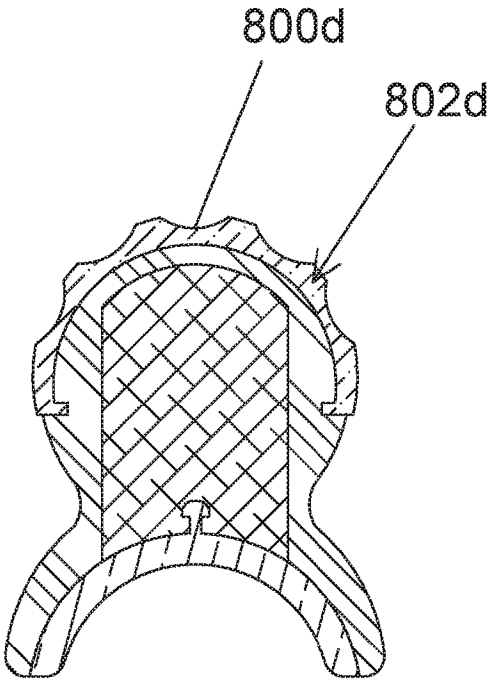

In one embodiment, the interchangeable sleeves 800*a-d* may define a second exterior massage-contact surface 802*a-d*. The second exterior massage-contact surface 802*a-d* may be provided in various shapes and sizes or with protrusions extending away from an inner spherical member-contacting surface of the sleeve 800*a-d*. This advantageously provides users the ability to emulate various types of massage techniques. Said differently, the second exterior massage-contact surface 802*a-d* may include a plurality of varying surface topographies, wherein each of the plurality of varying surface topographies are independently shaped with respect to one another and/or have different undulations, protrusions, and/or recesses. For example, in one embodiment as illustrated in FIG. 8C, the second exterior massage-contact surface 802*c* includes a plurality of massage projections 804. The plurality of massage projections 804 may extend outwardly and away from the spherical member 102 when the sleeve 800 is secured to the spherical member 102. The plurality of massage projections 804 may be provided in many forms, shapes and configurations. As depicted in FIGS. 8B-D, in one embodiment (e.g. FIG.8B), the massage projections 804 may be formed as a single bump or protrusion. In another embodiment (e.g. FIG.8C), the massage projections 804 may be formed as multiple bumps or protrusions. In yet another embodiment, the massage projections 804 may be shaped similar to a dimpled surface of a golf ball (e.g. FIG.8D). In yet other embodiments, the massage projections 804 may be provided as other shapes, sizes, and numbers.

The sleeves 800*a-d* may be made of various materials configured to aid in the user's application of various massage techniques. In one embodiment, the sleeves 800*a-d* may be made of a rubber, polyurethane foam, or other polymeric material. In another embodiment, the sleeves 800*a-d* may be made of other materials. The sleeves 800*a-d* may preferably be made of a soft or pliant material that provides a comfortable skin contact surface during a massage session.

In one embodiment, the spherical member 102 may define at least one groove 806. In another embodiment, the spherical member 102 may define a circular groove 806 that extends continuously about the spherical member 102 at, for example, a hemisphere line that equally divides the spherical member 102 in half. In yet another embodiment, the spherical member 102 may define a plurality of discontinuous grooves 806 extending about the spherical member 102. In other embodiments, the spherical member 102 may define other types, shapes, and configurations of grooves 806. As such, the spherical member 102 may form a tongue-and-grove or other retaining configuration with respect to the sleeves 800*a-d*.

The one or more sleeves 800*a-d* may include at least one lip 808 dimensioned to matingly fasten to the corresponding groove 806 defined by the spherical member 102 so as to secure the sleeve 800 on the spherical member 102. In one embodiment, the lip 808 may be shaped as a ledge. In another embodiment, the lip 808 and groove 806 may be formed as a tongue-and-groove type connection. In another embodiment, the inner surface of the sleeve 800 may be hook-and-loop fastener and the spherical member 102 may include a mating hook-and-loop fastener on its exterior surface that secures the sleeve 800 to the spherical member 102. In yet other embodiments, the lip 808 and groove 806 may be shaped, formed, dimensioned, and configured as other types of mating fasteners. In yet other embodiments, the sleeve 800 may include an adhesive that is disposed to adhere the sleeve 800 to the spherical member 102.

In one embodiment, the core 600 (see FIG. 6) may be covered or sealed by a bottom cover 810. The bottom cover 810 may be made of a plastic, rubber, silifootie or other like material so as to the cover the spherical member 102 and/or enclose the core 600. The bottom cover 810 may hook and/or latch onto the apparatus 100 through, for example, a protrusion and mating groove, or any other type of suitable fastener. In one embodiment, the bottom cover 810 is selectively removable from the apparatus 100. In another embodiment, the bottom cover 810 is built into or otherwise permanently affixed to the apparatus 100. In yet another embodiment, the apparatus 100 may not include a bottom cover 810.

In another embodiment, the barbell massage apparatus will have multiple sphere members 118. Said another way, as opposed from having one spherical member 118 extending away from the arms 104, 106 or U-shaped channel 110, the device 100 may have a plurality of spherical members 118, wherein each of the plurality of spherical members 118 may have removable sleeves 800 coupled thereto for more versatile massaging techniques and user-sensations.

A novel and efficient barbell massage apparatus that has been disclosed that, in one embodiment, mirrors the hardness and characteristics of an adult human elbow to provide a deep tissue massage. Such embodiments are effective in relieving muscle and connective tissue conditions and restrictions, including but not limited to trigger points and myofascial release on the foot, calf, leg, hip, glutes, entire arm, back, chest, shoulder, and neck ailments. Embodiments of the invention provide for the barbell massage apparatus to include a spherical massage member and at least two arms extending away from the spherical massage member and at least partially defining a U-shaped channel.

In addition, embodiments of the invention provide for the U-shaped channel to be sized and shaped to matingly receive and retain therein a barbell or a bar portion of a dumbbell. In such embodiments, the barbell or dumbbell may provide a dual-purpose as a handle to maneuver the barbell massage apparatus on a subject's muscle tissue and also as a heavy weight to conveniently provide weighted pressure on the barbell massage apparatus. Stated another way, the weight of the barbell (e.g., an empty barbell is typically between 35 and 55 lbs.) or the dumbbell weight can provide significant pressure or force on the barbell massage apparatus and ultimately on the human subject's muscle tissue. Applying pressure to muscle tissue during deep tissue massages, particularly on muscular and overweight individuals, can be especially strenuous to the person applying the pressure and over time can lead to injury. Accordingly, embodiments of the present invention advantageously at least partially alleviate the need for the massage professional (or the subject, in the case of a self-massage session) to exert as much force during the massage as would be required without the weighted assistance.

What is claimed is:

1. In combination with a barbell having a cylindrical surface, wherein an improvement comprises:

a barbell massage apparatus including:

a spherical member defining an exterior massage-contact surface;

at least two arms extending away from the exterior massage-contact surface that respectively flank two sides of the cylindrical surface of the barbell and retain the barbell massage apparatus thereon, the at least two arms at least partially defining a U-shaped channel with the cylindrical surface of the barbell disposed therein; and a spherical member sleeve sized and shaped to removably cover at least a portion of the exterior massage-contact surface, the spherical member sleeve defining a second exterior massage-contact surface;

wherein the spherical member defines at least one groove; and the spherical member sleeve includes at least one lip dimensioned to matingly fasten to the at least one groove so as to secure the spherical member sleeve on the spherical member, the second exterior massage-contact surface includes a plurality of massage projections that extends outwardly and away from the spherical member when the spherical member sleeve is secured to the spherical member through the at least one lip and the at least one groove.

2. The improvement in accordance with claim 1, wherein:

the at least two arms include a concave inner surface that defines the U-shaped channel, the concave inner surface frictionally retaining the cylindrical surface of the barbell without any external support forces.

3. The improvement in in accordance with claim 1, wherein:

the at least two arms are of a material that is sufficiently rigid to frictionally retain the cylindrical surface of the barbell within the U-shaped channel without any external support forces.

4. The improvement in accordance with claim 1, further comprising:

at least one magnet disposed on at least one of the spherical member and the at least two arms, the at least one magnet operably configured to produce a magnetic field sufficient to retain, without any external non-magnetic support forces, at least a combined weight of the spherical member and the at least two arms to a metallic structure.

5. The improvement in accordance with claim 1, wherein:

each of the at least two arms include a coupling end and a free end, the coupling end being coupled to the spherical member and the free end being disposed away from the exterior massage-contact surface.

6. The improvement in accordance with claim 1, wherein:

the at least two arms include an inner surface that at least partially defines the U-shaped channel, the inner surface being shaped to conform to a shape of a portion of the barbell.

7. The improvement in accordance with claim 1, wherein:

the spherical member defines a hollow core.

8. The improvement in accordance with claim 1, wherein:

the spherical member includes a core that is of a first material different than a second material of an outer layer of the spherical member, the outer layer surrounding the core and including the exterior massage-contact surface.

9. The improvement in accordance with claim 8, wherein:

the first material of the core is denser than the second material of the outer layer.

10. The improvement in accordance with claim 1, wherein:

the U-shaped channel includes a width that is 1-4 inches and a depth that is 1-3 inches, the width of the U-shaped channel extending from an inner surface of one of the at least two arms to an inner surface of another one of the at least two arms.

11. The improvement in accordance with claim 1, wherein:

the spherical member includes a diameter that is 1-4 inches.

* * * * *